US009408463B2

(12) United States Patent
McGregor

(10) Patent No.: US 9,408,463 B2
(45) Date of Patent: Aug. 9, 2016

(54) UNDERMOUNT DRAWER SLIDE POSITION ADJUSTMENT APPARATUS AND METHOD OF USE

(71) Applicant: Hardware Resources, Inc., Bossier City, LA (US)

(72) Inventor: Dennis McGregor, Bossier City, LA (US)

(73) Assignee: HARDWARE RESOURCES, INC., Bossier City, LA (US)

( * ) Notice: Subject to any disclaimer, the term of this patent is extended or adjusted under 35 U.S.C. 154(b) by 0 days.

(21) Appl. No.: 14/821,979

(22) Filed: Aug. 10, 2015

(65) Prior Publication Data

US 2015/0342347 A1 Dec. 3, 2015

Related U.S. Application Data

(63) Continuation of application No. 14/088,053, filed on Nov. 22, 2013, now Pat. No. 9,101,213.

(51) Int. Cl.
*A47B 88/04* (2006.01)

(52) U.S. Cl.
CPC ..... *A47B 88/0422* (2013.01); *A47B 88/0407* (2013.01); *A47B 2088/0433* (2013.01); *Y10T 29/4984* (2015.01)

(58) Field of Classification Search
CPC ..... A47B 88/0407; A47B 88/0418; A47B 88/0422; A47B 88/044; A47B 2210/0054
USPC ..... 312/334.4, 334.5, 348.4, 333
See application file for complete search history.

(56) References Cited

U.S. PATENT DOCUMENTS

| | | | | | |
|---|---|---|---|---|---|
| 139,228 | A * | 5/1873 | Arnold | F16K 31/05 | 16/210 |
| 808,927 | A * | 1/1906 | Hunn | F16K 31/05 | 74/89.45 |
| 4,441,773 | A * | 4/1984 | Leiper | A47B 88/14 | 312/330.1 |
| 5,306,080 | A * | 4/1994 | Lautenschlager | A47B 88/044 | 312/334.5 |
| 5,580,139 | A * | 12/1996 | Grabher | A47B 88/0422 | 312/333 |
| 6,027,193 | A * | 2/2000 | Domenig | A47B 88/0462 | 312/334.14 |

(Continued)

FOREIGN PATENT DOCUMENTS

| | | |
|---|---|---|
| EP | 0761132 | 3/1997 |
| EP | 1440631 | 7/2007 |

(Continued)

*Primary Examiner* — Daniel Rohrhoff
(74) *Attorney, Agent, or Firm* — Schultz & Associates, P.C.

(57) ABSTRACT

An undermount drawer slide mounting clip releasably attaches a drawer to a drawer rail assembly mounted in a cabinet carcass. The apparatus is capable of effecting positional adjustments of the drawer in three directions without removing the drawer from the cabinet carcass. The apparatus is comprised of a body slidingly engaged with a bonnet. A trigger pivotally connected between the body and the bonnet. A spring loaded catch slidable within the bonnet and acted on by the trigger to releasably attach the apparatus to a drawer rail assembly. A threaded spindle rotates within the base and adjusts the horizontal position of the drawer. A ramp adjustably connected to the base adjusts the vertical position of the drawer. A plunger extends from a housing connected to the body and is adjacent the drawer rail assembly. A lever pivotable within the housing moves the plunger and adjusts the depth of the drawer.

18 Claims, 6 Drawing Sheets

(56) References Cited

U.S. PATENT DOCUMENTS

| | | | | |
|---|---|---|---|---|
| 6,837,557 | B2 * | 1/2005 | Domenig | A47B 88/047 312/334.27 |
| 6,913,334 | B2 | 7/2005 | Weichelt | |
| 8,016,374 | B2 * | 9/2011 | Kropf | A47B 88/04 312/333 |
| 8,056,994 | B2 * | 11/2011 | Chen | A47B 88/0422 312/334.14 |
| 8,424,984 | B2 | 4/2013 | Ritter | |
| 8,696,078 | B2 * | 4/2014 | Gasser | A47B 88/0422 312/334.5 |
| 8,764,136 | B2 * | 7/2014 | Grabherr | A47B 88/0422 312/334.27 |
| 8,991,952 | B2 * | 3/2015 | Salice | A47B 88/0422 312/334.4 |
| 9,101,213 | B2 * | 8/2015 | McGregor | A47B 88/0422 |
| 2002/0158557 | A1 * | 10/2002 | Weichelt | A47B 88/0422 312/334.4 |
| 2004/0239219 | A1 * | 12/2004 | Kim | A47B 88/0422 312/334.4 |
| 2009/0167128 | A1 * | 7/2009 | Berger | A47B 88/0422 312/334.4 |
| 2009/0212679 | A1 * | 8/2009 | Frousiakis | A47B 88/0422 312/334.1 |
| 2009/0236959 | A1 * | 9/2009 | Liang | A47B 88/0422 312/334.4 |
| 2012/0017414 | A1 * | 1/2012 | Cerniglia | A47B 88/044 29/428 |
| 2012/0176015 | A1 * | 7/2012 | Liang | A47B 88/0422 312/334.4 |
| 2012/0292465 | A1 | 11/2012 | Holzer et al. | |
| 2014/0314374 | A1 * | 10/2014 | Fattal | G02B 6/124 385/33 |

FOREIGN PATENT DOCUMENTS

| | | |
|---|---|---|
| EP | 2208442 | 7/2010 |
| GB | 2095537 | 10/1982 |
| GB | 2440306 | 1/2006 |
| WO | 2012069337 | 5/2012 |

* cited by examiner

UNDERMOUNT DRAWER SLIDE POSITION ADJUSTMENT APPARATUS AND METHOD OF USE

CROSS REFERENCE TO RELATED APPLICATIONS

This application is a Continuation of application Ser. No. 14/088,053, filed Nov. 22, 2013. The patent application identified above is incorporated here by reference in its entirety to provide continuity of disclosure.

FIELD OF INVENTION

This disclosure relates to the field of drawer slides for mounting drawers in cabinetry. More particularly this disclosure relates to an undermount drawer slide mounting clip for releasably coupling a drawer to a drawer slide assembly.

BACKGROUND

Drawer slide assemblies include slides or rails mounted on both the cabinet carcass and the drawer. The slides attached to the drawer cooperate with the slides mounted to the cabinet carcass to allow telescoping extensions while providing support for the drawer. Drawer slides typically are mounted either underneath the drawer or on the sides of a drawer. Both the undermount drawer slide and the sidemount drawer slide styles offer different advantages. A desirable advantage of the undermount drawer slide is that it is not visible when a drawer is open and the slide is extended. To consumers, the appearance of the drawer is enhanced.

Adjustment of the drawer face of a drawer mounted using an undermount drawer slide assembly is also important to appearance. Overcoming misalignment of an installed drawer relative to the cabinet and any adjacent drawers due to manufacturing tolerances is necessary. Adjustments are often necessary in three directions, "horizontal", "vertical", and "depth".

Releasable coupling devices which allow a drawer to be fitted to an extendable rail of a drawer assembly are known in the art.

U.S. Pat. No. 6,913,334 to Weichelt discloses a device for establishing an adjustable connection between a drawer and a furniture guide rail. The device comprises a base part adapted for connection to the drawer and a detent recess adapted for connection to the guide rail. The tolerance between the drawer and the guide rail may be manually adjusted in two directions and the furniture guide rail must include a suitable detent for engagement with the detent recess.

U.S. Pat. No. 8,424,984 to Ritter discloses an apparatus for releasably coupling a drawer to a drawer pull-out guide. The apparatus comprises a holding part which interacts with a mating part of the guide rail. A region of the holding part which comes in contact with the mating part of the guide rail is flexible to compensate any longitudinal play of the drawer in relation to the rail. In addition to the flexible depth compensation, the apparatus provides the capability of a "horizontal" adjustment.

U.S. Patent Application Publication No. 2012/0292465 to Holzer; et al. discloses a coupling device for a drawer. The device comprises a fixing portion mounted to the drawer and a coupling portion for releasably interacting with the guide rail. The device is capable of providing an adjustment in a "vertical" direction and a "horizontal" direction.

However, a simple, cost effective, and easy to operate solution providing a quick, releasable engagement to an existing drawer slide assembly capable of providing three directional adjustments is needed. Further, there is a need for an easily operated undermount drawer slide mounting clip capable of releasably coupling a drawer to a drawer slide assembly and providing three-directional adjustment that can be operated by hand without removing the drawer from the cabinet carcass.

SUMMARY

The apparatus disclosed is an undermount drawer slide clip mounting apparatus configured to releasably attach a drawer to a drawer slide assembly mounted in a cabinet carcass and capable of effecting adjustments in three directions without removing the drawer from engagement with the cabinet.

Accordingly, the drawer slide assembly is comprised of a cabinet rail mounted to the cabinet carcass, an intermediate rail slidingly engaged with the cabinet rail, and a drawer rail slidingly engaged with the intermediate rail. The undermount drawer slide clip mounting apparatus is comprised of a body including a base slidingly engaged with a bonnet. A lever arm is pivotally engaged with the body and a spring loaded catch is slidable within the bonnet. A threaded spindle rotates within the base and affects the lateral position of the bonnet relative to the base. A height adjusting ramp is adjustably connected to the base. A depth adjuster is connected to the base and includes a lever pivotal within a housing and a cover. The lever includes gear teeth engaged with gear teeth on a plunger extending from the housing.

The base of the undermount drawer slide clip is mounted to the underside of a drawer. A trigger moves the catch for releasable engagement with the drawer rail of the drawer slide assembly. The drawer rail further engages the ramp. The position of the ramp relative to the base can be adjusted to affect the vertical position of the drawer. Rotation of the spindle moves the lateral position of the bonnet relative to the base and thus imparts a lateral adjustment of the drawer. When the drawer is closed, the cabinet rail of the drawer slide assembly contacts the plunger. Pivoting the lever moves the position of the plunger and provides a depth adjustment.

BRIEF DESCRIPTION OF DRAWINGS

In the descriptions that follow, like parts are marked throughout the specification and drawings with the same numerals, respectively. The drawing figures are not necessarily drawn to scale and certain figures may be shown in exaggerated or generalized form in the interest of clarity and conciseness.

DETAILED DESCRIPTION OF PREFERRED EMBODIMENTS

Figure 1:
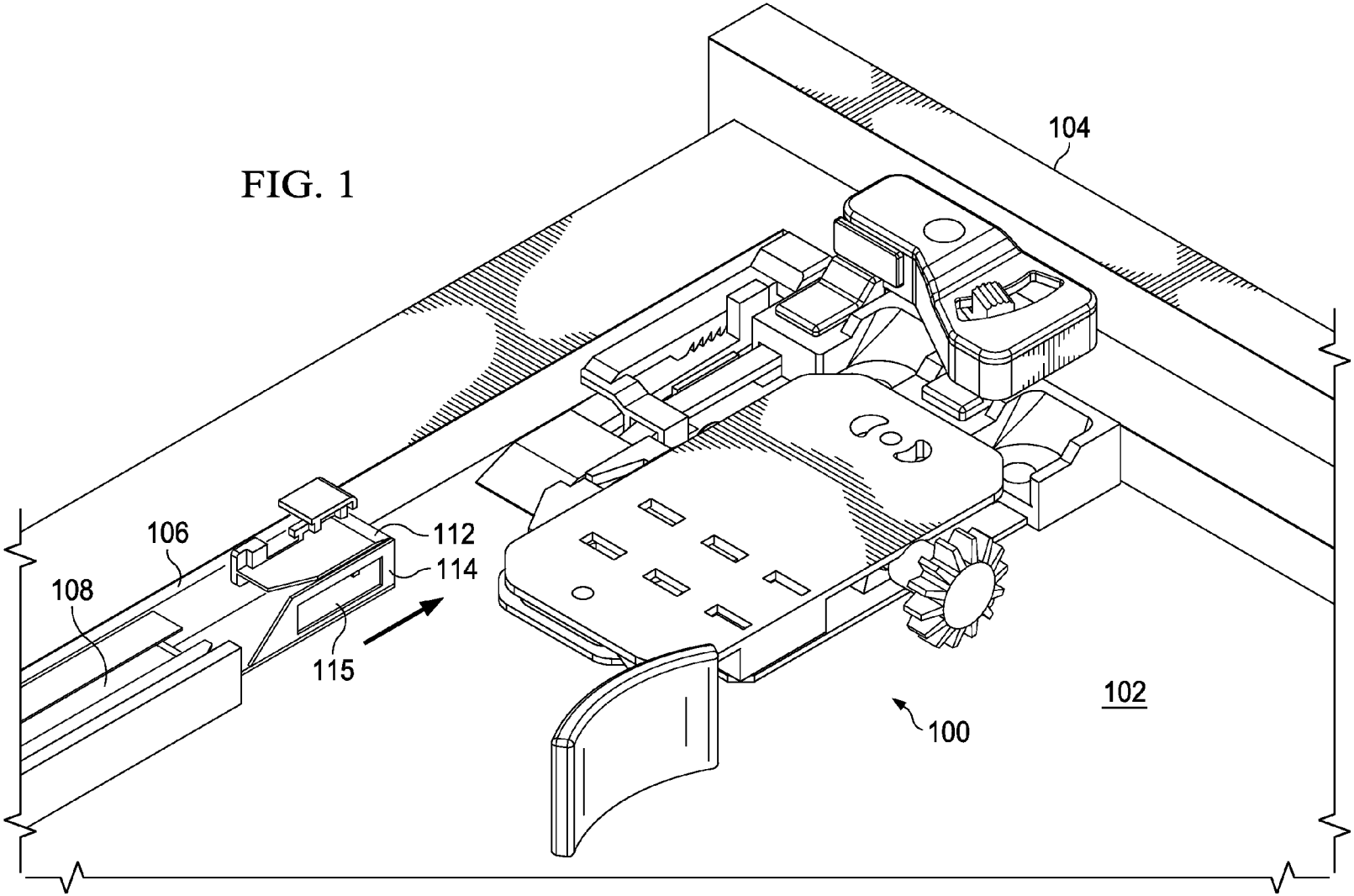
FIG. 1 is an isometric view of a preferred embodiment attached to the underside of a drawer.
Figure 6A:
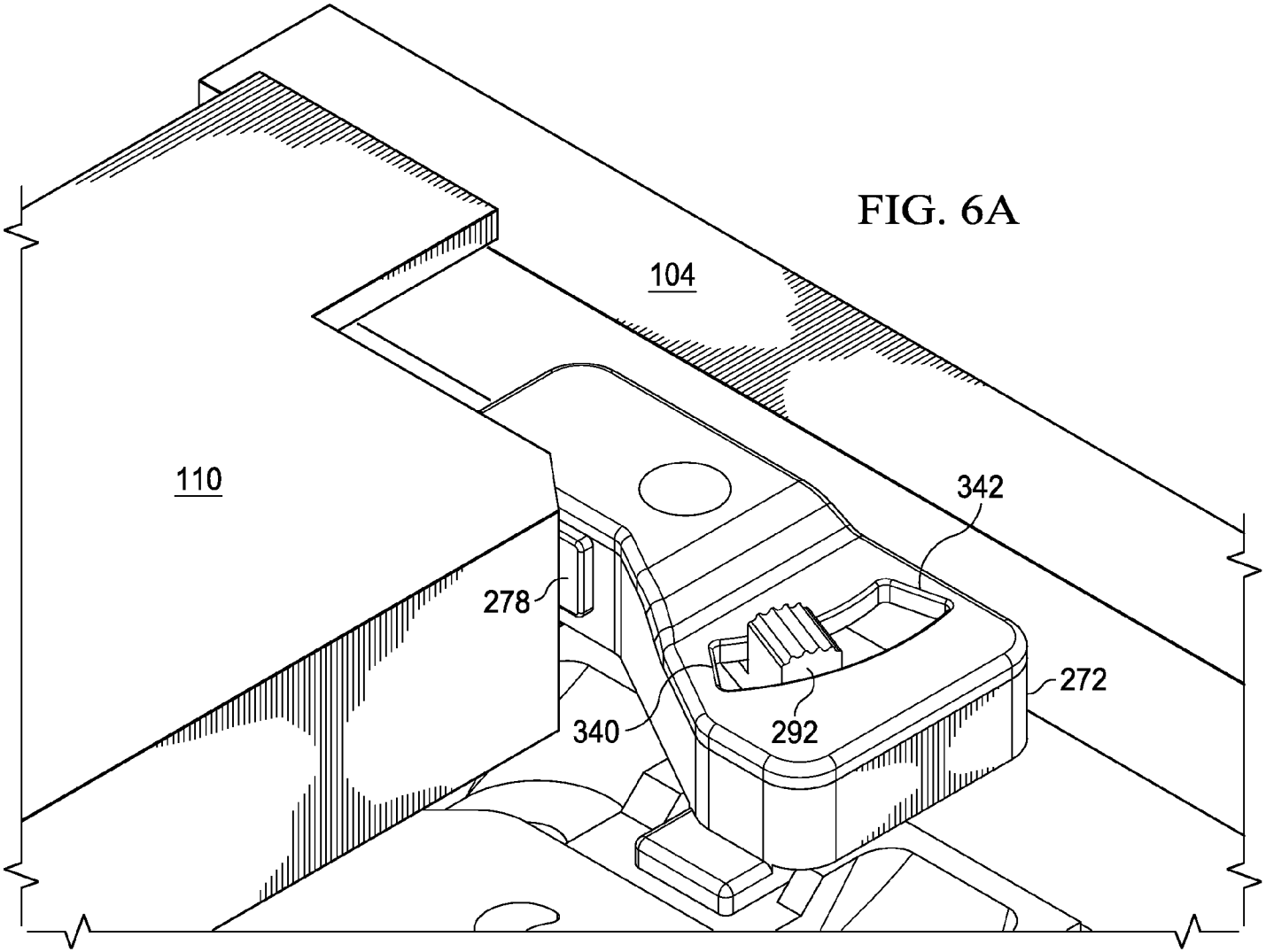
FIG. 6A is an isometric view of a preferred embodiment of the depth adjuster.
Figure 6B:
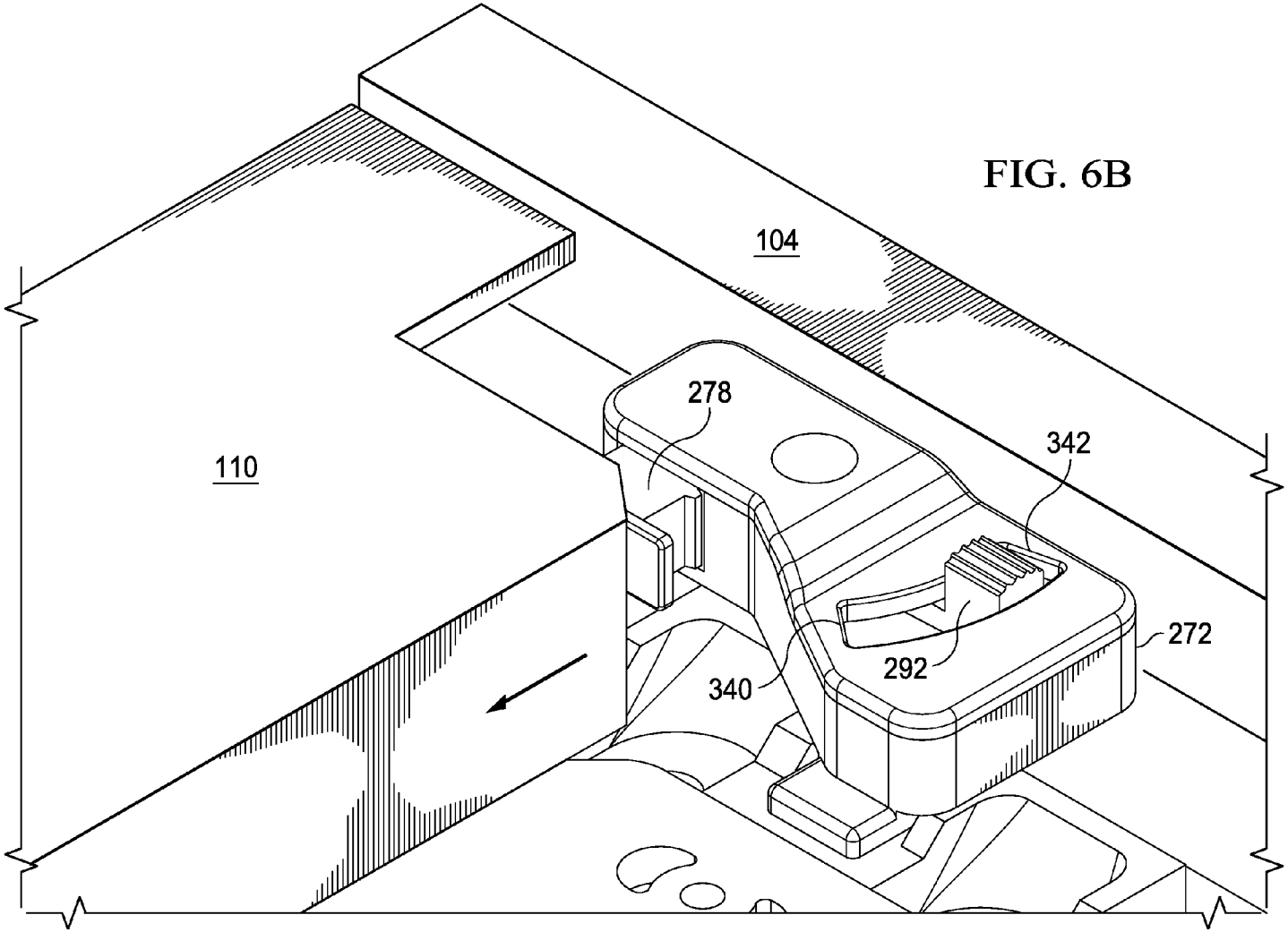
FIG. 6B is an isometric view of a preferred embodiment of the depth adjuster.

Referring to FIG. 1, the underside of drawer 102 is shown. Undermount drawer slide clip mounting apparatus 100 is mounted on the underside of the drawer adjacent drawer face 104. The front mounted location allows for easy adjustment by hand without disengaging the drawer from the drawer slide assembly. The drawer slide assembly is comprised of three slidingly engaged rails as is common in the art. Drawer rail 106 is removably engaged with mounting apparatus 100 and slidingly engaged with intermediate rail 108. Intermediate rail 108 is slidingly engaged with cabinet rail 110 (FIGS. 6A and 6B). Cabinet rail 110 is mounted to the cabinet carcass with conventional mounting hardware such as wood screws. Drawer rail 106 includes tab 114 and is further fitted with shoe 112. Tab 114 defines slot 115. Both shoe 112 and tab 114 are positioned on the front end of drawer rail 106.

Figure 2:
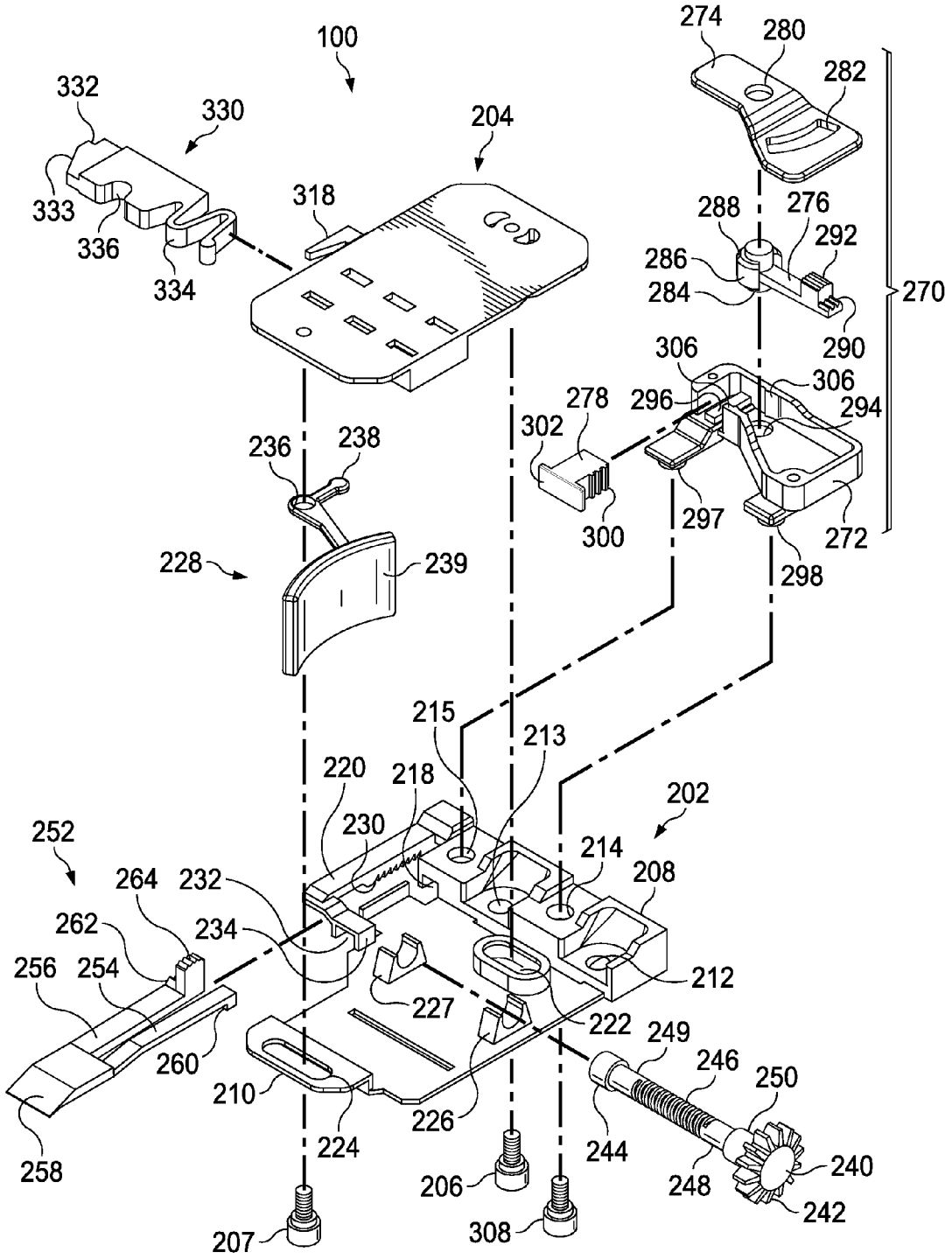
FIG. 2 is an exploded isometric view of a preferred embodiment.
Figure 3:
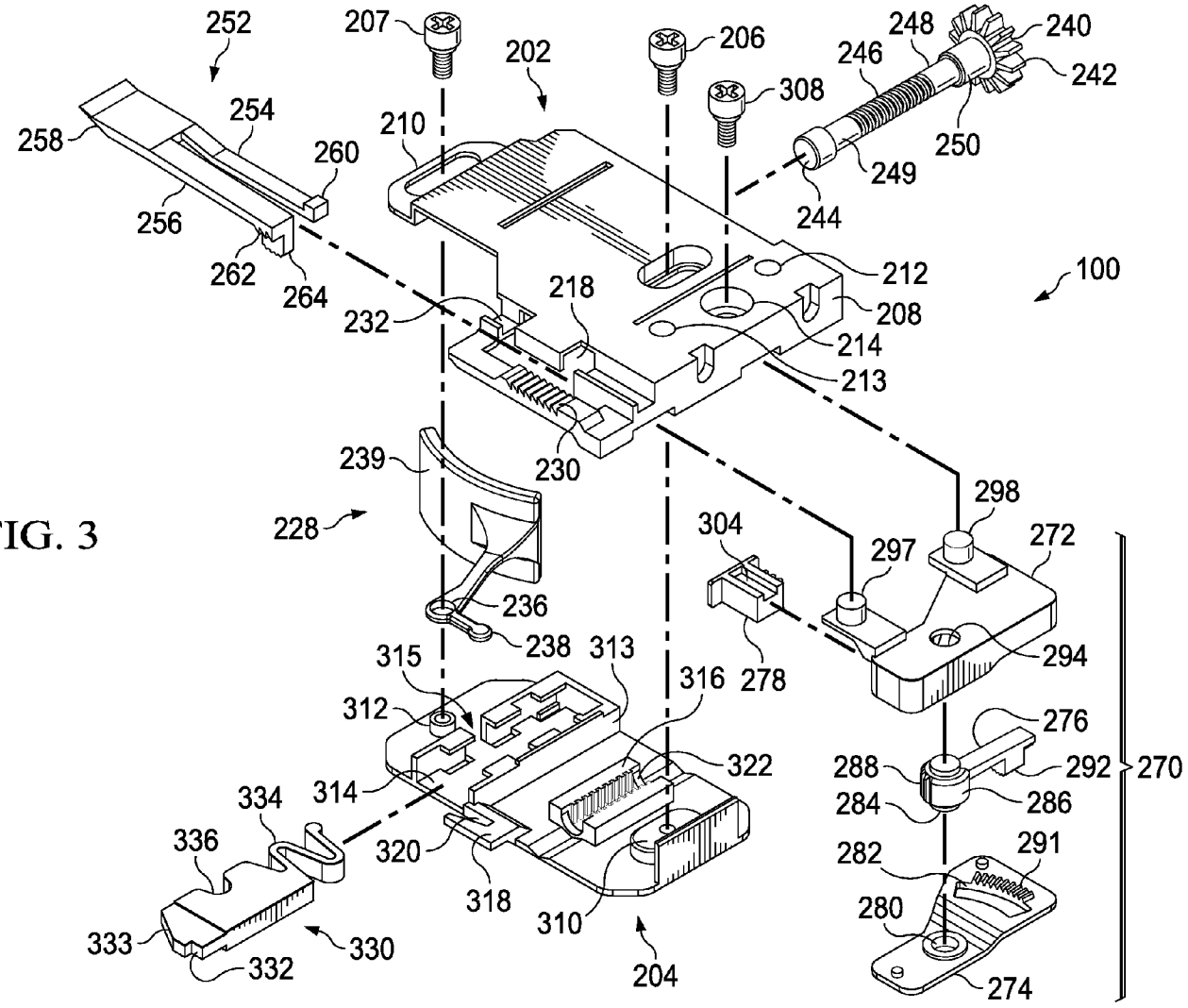
FIG. 3 is an exploded isometric view of a preferred embodiment.

Referring to FIGS. 2 and 3, undermount drawer slide clip mounting apparatus 100 is comprised of base 202 slidingly engaged with bonnet 204. Base 202 is a generally flat, rectangular plate rigidly mounted to the underside of the drawer with convention mounting hardware such as wood screws through holes 212 and 213. Base 202 includes ends 208 and 210. End 208 is mounted adjacent drawer face 104. End 208 includes holes 214 and 215. Hole 214 passes completely though base 202 while hole 215 may or may not pass completely through. Recess 218 is a rectangular shaped cutout beneath hole 215.

Saddles 226 and 227 project from base 202 near the longitudinal midpoint of base 202. Bridge 220 extends from end 208 adjacent hole 215, projects along an edge of base 202, and reconnects to base 202 adjacent saddle 227 forming block 234. Bridge 220 includes teeth 230 and recess 232. Spindle 240 is a threaded shaft with knob 242 adjacent collar 250 on one end and barrel 244 on the opposite end. Spindle 240 has threaded section 246 flanked by two bare sections 248 and 249. Bare sections 248 and 249 are seated in saddles 226 and 227 respectively. Collar 250 is adjacent saddle 226. Barrel 244 is adjacent saddle 227.

Height adjuster 252 is adjustably engaged with base 202 at bridge 220. Height adjuster 252 is comprised of arms 254 and 256 extending generally parallel to each other from ramp 258. Opposite ramp 258, arm 254 includes hook 260. Opposite ramp 258, arm 256 includes teeth 262 adjacent extension 264. Teeth 262 are sized to engage teeth 230 and hook 260 is sized to engage recess 218.

Lever arm 228 is generally elbow shaped and comprised of strike 238 on one end and trigger 239 on an opposite end. Pivot hole 236 is displaced between the ends at the elbow bend. Lever arm 228 is pivotally connected between base 202 and bonnet 204 with screw 207 through pivot hole 236.

Bonnet 204 is a generally flat, rectangular plate slidingly engaged with base 202. Screws 206 and 207 affix bonnet 204 to base 202 through oblong holes 222 and 224 respectively. Stanchions 310 and 312 extend from bonnet 204. Each stanchion includes a hole to receive screws 206 and 207. The generally rectangular, hollow shape of box 313 forms channel 314 adjacent stanchion 312. One side wall of box 313 includes gap 315. Block 316 is positioned adjacent stanchion 310 and includes threaded slot 322. The threads of threaded slot 322 are sized to engage threaded section 246 of spindle 240. Arm 318 extends from bonnet 204 and further includes slot 320. The longitudinal axes of channel 314 and threaded slot 322 are generally parallel to each other and generally perpendicular to the longitudinal axis of slot 320. In the preferred embodiment, stanchions 310 and 312, box 313, block 316, and arm 318 are all integrally formed with bonnet 204.

Catch 330 is sized to be slidably engaged with channel 314. Catch 330 includes notch 332 adjacent angled edge 333 on a first end and spring 334 on an opposite end. Disposed between the two ends of catch 330 is slot 336. Slot 336 is sized to accommodate strike 238 of lever arm 228.

Figure 5:
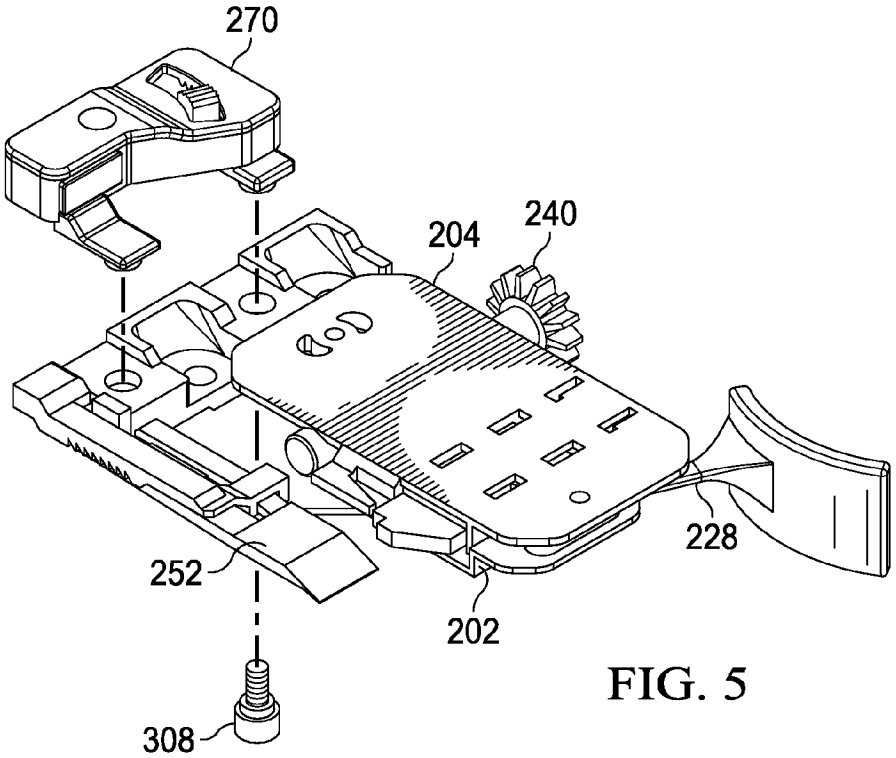
FIG. 5 is a partially exploded isometric view of a preferred embodiment showing attachment of the depth adjuster.
Figure 4:
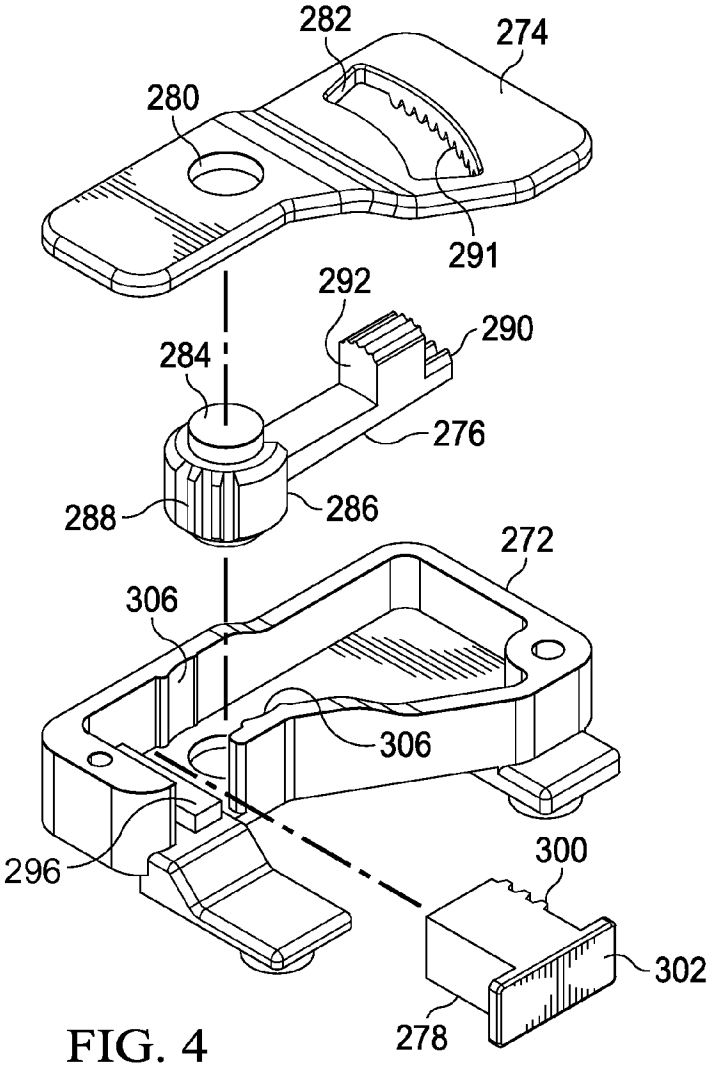
FIG. 4 is an exploded isometric view of a preferred embodiment of the depth adjuster.

Referring additionally to FIGS. 4 and 5, depth adjuster 270 is comprised of housing 272 fitted with cover 274. Housing 272 has a generally rectangular shaped, hollow body including pivot hole 294. Stanchions 297 and 298 extend from one side of housing 272. Stanchion 298 includes a hole sized to receive screw 308. Adjacent pivot hole 294 is rib 296. Partially surrounding pivot hole 294 and integrally formed into opposing sidewalls of housing 272 are arcuate guides 306.

Cover 274 is a Z-shaped, generally rectangular plate releasable fitted to housing 272. Cover 274 includes pivot hole 280 and arcuate slot 282. Adjacent arcuate slot 282, cover 274 further includes an arcuate strip of teeth 291. Lever 276 includes axel 284 on a first end and teeth 290 adjacent extension 292 on its opposite end. Teeth 290 are sized to engage teeth 291. Lever 276 is pivotally engaged with housing 272 and cover 274 by axel 284 through pivot holes 294 and 280. Surrounding axel 284 is collar 286. Collar 286 is sized to rotate freely between arcuate guides 306 and further includes teeth 288. Plunger 278 has a hollow, T-shaped body where face 302 is positioned along the top of the "T". Plunger 278 further includes slot 304 sized to accommodate rib 296 of housing 272 and teeth 300 sized to engage teeth 288 of lever 276.

Depth adjuster 270 is rigidly connected to base 202 by screw 308 through hole 214 and the hole in stanchion 298. Stanchion 297 is fitted to bole 215.

In the preferred embodiment, components of undermount drawer slide clip mounting apparatus 100 including base 202, bonnet 204, lever arm 228, spindle 240, height adjuster 252, depth adjuster 270, and catch 330 are manufactured of a molded plastic such as polystyrene, PVC (polyvinyl chloride), or nylon.

In use, dip mounting apparatus 100 is affixed to the underside of the drawer, adjacent drawer face 104, with screws through holes 212 and 213. To releasably clip the drawer to drawer rail 106, lever arm 228 is pivoted about pivot hole 236 by applying a force to trigger 239 in a direction generally parallel to the bottom surface of the drawer towards the drawer slide assembly. Trigger 239 is sized and shaped to be manipulated by hand without tools. Strike 238 projects through gap 315, abuts catch 330 within slot 336, and slides catch 330 within channel 314 against the bias of spring 334. Tab 114 of drawer rail 106 is slidingly inserted into slot 320 and the front end of drawer rail 106 slides over ramp 258 on height adjuster 252. Trigger 239 is released allowing notch 332 to pass through slot 115 and under shoe 112. Angled edge 333 assists in the alignment of notch 332 with slot 115.

To adjust the vertical position of the drawer relative to the cabinet carcass, a force is applied to extension 264 in a direction towards the bottom of the drawer. Teeth 262 are released from their engagement with teeth 230. As long, as teeth 262 and teeth 230 are disengaged, height adjuster 252 is free to slide relative to base 202 in a direction generally parallel with the opening and closing direction of the drawer. Sliding height adjuster 252 towards drawer rail 106 causes the front end of drawer rail 106 to move up ramp 258 and thus the drawer in an upward direction relative to the cabinet carcass. Sliding height adjuster away from drawer rail 106 causes the front end of drawer rail 106 to move down ramp 258 and thus the drawer in a downward direction relative to the cabinet carcass. Hook 260 engaged with recess 218 limits the sliding movement of height adjuster 252 and prevents height adjuster 252 from becoming disengaged with base 202. Once the desired drawer height is reached, the force on extension 264 is released and teeth 262 reengage teeth 230.

To adjust the horizontal position of the drawer relative to the cabinet carcass, a rotational force is applied to spindle 240 via knob 242. During rotation, the spindle's horizontal position relative to base 202 is prevented from changing by barrel 244 abutting saddle 227 and collar 250 abutting saddle 226. Threaded section 246 interacts with threaded slot 322. As spindle 240 rotates, bonnet 204 moves horizontally with respect to base 202. Drawer rail 106 is releasably dipped to bonnet 204 via arm 318 and slot 320. Once the desired horizontal position is reached, rotation of spindle 240 is stopped.

As shown in FIGS. 6A and 6B, when the drawer is in a closed position, cabinet rail 110 abuts face 302 on plunger 278. The position of plunger 278 and thus face 302 determines the depth of the drawer relative to the cabinet carcass. To adjust the depth the drawer closes to relative to the cabinet carcass, plunger 278 is extended from or retracted within housing 272. As plunger 278 extends from housing 272, the closed position of the drawer relative to the cabinet carcass is extended further out of the cabinet carcass. To extend plunger 278 out of housing 272, a force is applied to extension 292 to release teeth 290 from engagement with teeth 291. Once the teeth are disengaged, lever 276 is pivoted about pivot hole 280 via axel 284. Rotation of collar 286 is confined by arcuate guides 306. Teeth 288 engaged with teeth 300 convert the rotational movement of lever 276 into linear movement of plunger 278. Movement of extension 292 from point 340 to point 342 translates into extending plunger 278 from housing 272 resulting in a closed position where the position of the drawer relative to the cabinet carcass is extended further out of the cabinet carcass. Movement of extension 292 from point 342 to point 340 translates into retracting plunger 278 back into housing 272 resulting in a closed position where the position of the drawer relative to the cabinet carcass is retracted, or less extended out of the cabinet carcass. Once the desired depth is achieved, the force on extension 292 is removed and teeth 290 reengage with teeth 291. It is understood that extension 292 may also be positioned anywhere between points 340 and 342 along arcuate slot 282 to effect different drawer closing depths.

It will be appreciated by those skilled in the art that changes could be made to the embodiments described above without departing from the broad inventive concept. It is understood, therefore, that this disclosure is not limited to the particular embodiments herein, but it is intended to cover modifications within the spirit and scope of the present disclosure as defined by the appended claims.

The invention claimed is:

1. A drawer slide clip mounting apparatus for releasably connecting a drawer to a drawer slide assembly mounted in a cabinet carcass, the apparatus comprising:

a base configured to be mounted to the drawer;

a cover slidingly engaged with the base and configured to be releasably connected to the drawer slide assembly;

an adjustable plunger, mounted to the base and adjacent the drawer slide assembly;

a housing slidingly engaged with the plunger and connected to the base;

a lever pivotable within the housing and having a first set of teeth, the lever operatively connected to the plunger;

a cap connected to the housing and having a second set of teeth engaged with the first set of teeth; and, an arcuate slot in the cap through which the lever extends; and, wherein the apparatus adjusts a depth position of the drawer relative to the cabinet carcass when the plunger is repositioned relative to the base.

2. The drawer slide clip mounting apparatus of claim 1 wherein the plunger extends from the housing a first distance when the lever is pivoted to a first location and the plunger extends from the housing a second distance when the lever is pivoted to a second location.

3. The drawer slide clip mounting apparatus of claim 1 wherein the lever is pivoted to adjust a closing depth of the drawer relative to the cabinet carcass when the first set of teeth is disengaged from the second set of teeth.

4. The drawer slide clip mounting apparatus of claim 1 further comprising:

a ramp, adjustably engaged with the base and adjacent the drawer slide assembly;

an arm extending from the ramp;

a first set of teeth disposed on the arm;

a second set of teeth integrally formed with the base and engaged with the first set of teeth; and, wherein the apparatus adjusts a vertical position of the drawer relative to the cabinet carcass when the ramp is repositioned relative to the base.

5. The drawer slide clip mounting apparatus of claim 4 wherein the ramp is slidingly repositioned to adjust the vertical position of the drawer relative to the cabinet carcass when the first set of teeth is disengaged from the second set of teeth.

6. The drawer slide clip mounting apparatus of claim 1 further comprising:

a threaded shaft, seated in the base and engaged with the cover;

wherein the apparatus adjusts a horizontal position of the drawer relative to the cabinet carcass upon rotation of the threaded shaft.

7. The drawer slide clip mounting apparatus of claim 6 wherein rotation of the threaded shaft adjusts a horizontal position of the cover relative to the base.

8. The drawer slide clip mounting apparatus of claim 1 further comprising:

a threaded shaft, seated in the base and engaged with the cover;

a first saddle extending from the base for engagement with a first non-threaded section of the threaded shaft and a second saddle extending from the base for engagement with a second non-threaded section of the threaded shaft; and, a knob adjacent the first non-threaded section and a barrel adjacent the second non-threaded section where the knob abuts the first saddle and the barrel abuts the second saddle.

9. A drawer slide clip mounting apparatus for releasably connecting a drawer to a drawer slide assembly mounted in a cabinet carcass, the apparatus comprising:

a base configured to be mounted to the drawer;

a cover slidingly engaged with the base and configured to be releasably connected to the drawer slide assembly;

a height adjuster, adjustably engaged with the base and adjacent the drawer slide assembly;

a first set of teeth disposed on the height adjuster;

a second set of teeth integrally formed with the base and engaged with the first set of teeth;

wherein the apparatus adjusts a vertical position of the drawer relative to the cabinet carcass when the height adjuster is repositioned relative to the base; and, wherein the height adjuster is repositioned to adjust the vertical position of the drawer relative to the cabinet carcass when the first set of teeth is disengaged from the second set of teeth.

10. The drawer slide clip mounting apparatus of claim 9 wherein the height adjuster further comprises:

a ramp, adjustably engaged with the base and adjacent the drawer slide assembly;

a first arm extending from the ramp;

a second arm extending from the ramp, where the first arm is generally parallel to the second arm;

the first set of teeth formed on the first arm; and, a hook, extending from the second arm and configured to slidingly engage a recess in the base.

11. The drawer slide clip mounting apparatus of claim 9 further comprising:

a threaded shaft, seated in the base and engaged with the cover;

wherein the apparatus adjusts a horizontal position of the drawer relative to the cabinet carcass upon rotation of the threaded shaft.

12. The drawer slide clip mounting apparatus of claim 11 wherein rotation of the threaded shaft adjusts a horizontal position of the cover relative to the base.

13. The drawer slide clip mounting apparatus of claim 9 further comprising:

a threaded shaft, seated in the base and engaged with the cover;

a first saddle extending from the base for engagement with a first non-threaded section of the threaded shaft and a second saddle extending from the base for engagement with a second non-threaded section of the threaded shaft; and, a knob adjacent the first non-threaded section and a barrel adjacent the second non-threaded section where the knob abuts the first saddle and the barrel abuts the second saddle.

14. The drawer slide clip mounting apparatus of claim 9 further comprising:

an adjustable plunger, mounted to the base and adjacent the drawer slide assembly; and, wherein the apparatus adjusts a depth position of the drawer relative to the cabinet carcass when the plunger is repositioned relative to the base.

15. A drawer slide clip mounting apparatus for releasably connecting a drawer to a drawer slide assembly mounted in a cabinet carcass, the apparatus comprising:

a base configured to be mounted to the drawer;

a cover slidingly engaged with the base;

a catch slidable within the base and configured to be releasably connected to the drawer slide assembly;

a threaded shaft, seated in the base and engaged with the cover; and, wherein the apparatus adjusts a horizontal position of the drawer relative to the cabinet carcass upon rotation of the threaded shaft.

16. The drawer slide clip mounting apparatus of claim 15 further comprising:

a first saddle extending from the base configured to engage a first non-threaded section of the threaded shaft and a second saddle extending from the base configured to engage a second non-threaded section of the threaded shaft; and, a knob adjacent the first non-threaded section and a barrel adjacent the second non-threaded section where the knob abuts the first saddle and the barrel abuts the second saddle.

17. The drawer slide clip mounting apparatus of claim 15 further comprising:

a ramp, adjustably engaged with the base and adjacent the drawer slide assembly;

an arm extending from the ramp;

a first set of teeth disposed on the arm;

a second set of teeth integrally formed with the base and engaged with the first set of teeth; and, wherein the apparatus adjusts a vertical position of the drawer relative to the cabinet carcass when the ramp is repositioned relative to the base.

18. The drawer slide clip mounting apparatus of claim 15 further comprising:

an adjustable plunger, mounted to the base and adjacent the drawer slide assembly; and, wherein the apparatus adjusts a depth position of the drawer relative to the cabinet carcass when the plunger is repositioned relative to the base.

* * * * *